US008982029B2

(12) United States Patent
Wu et al.

(10) Patent No.: US 8,982,029 B2
(45) Date of Patent: Mar. 17, 2015

(54) PIXEL CIRCUITRY OF DISPLAY DEVICE AND DISPLAY METHOD THEREOF

(75) Inventors: Biing-Seng Wu, Tainan County (TW); Hon-Yuan Leo, Tainan County (TW); Cheng-Chi Yen, Tainan County (TW); Yih-Long Tseng, Tainan County (TW); Yung-Yuan Ho, Tainan County (TW); Yen-Chen Chen, Tainan County (TW)

(73) Assignee: Himax Display, Inc., Tainan (TW)

( * ) Notice: Subject to any disclaimer, the term of this patent is extended or adjusted under 35 U.S.C. 154(b) by 957 days.

(21) Appl. No.: 12/466,690

(22) Filed: May 15, 2009

(65) Prior Publication Data

US 2010/0289734 A1 Nov. 18, 2010

(51) Int. Cl.
*G09G 3/36* (2006.01)

(52) U.S. Cl.
CPC ..... *G09G 3/3614* (2013.01); *G09G 3/3655* (2013.01); *G09G 2320/0247* (2013.01)
USPC ..... 345/98

(58) Field of Classification Search
USPC ..... 345/98, 100, 99
See application file for complete search history.

(56) References Cited

U.S. PATENT DOCUMENTS 4,531,154 A * 7/1985 Hallock ..... 348/510
5,812,106 A * 9/1998 Hughes ..... 345/90
6,151,006 A * 11/2000 Yanagi et al. ..... 345/94
6,424,330 B1 * 7/2002 Johnson ..... 345/96
6,864,874 B1 * 3/2005 Ozawa ..... 345/99
7,460,047 B2 * 12/2008 Zhang et al. ..... 341/144
2005/0116918 A1 * 6/2005 Shin ..... 345/100
2005/0168427 A1 * 8/2005 Odom ..... 345/98
2006/0077800 A1 * 4/2006 Hsieh et al. ..... 369/44.27
2006/0187329 A1 8/2006 Panicacci

FOREIGN PATENT DOCUMENTS

CN 1120466 9/2003
CN 1675674 9/2005
TW 507180 10/2002

OTHER PUBLICATIONS

"Office Action of Taiwan Counterpart Application", issued on Jun. 27, 2013, p. 1-8.

* cited by examiner

*Primary Examiner* — Jonathan Blancha
(74) *Attorney, Agent, or Firm* — J. C. Patents

(57) ABSTRACT

A pixel circuitry of a display device and a display method thereof are provided herein. The pixel circuitry includes a scan switch, a storage element, and a sampling circuitry. The scan switch has a first terminal coupled to a data line and configured to be asserted according to a scan signal. The storage element is coupled to a second terminal of the scan switch and configured to store a pixel voltage from the data line. The sampling circuitry is configured to sample the stored pixel voltage of the storage element and to obtain a reference voltage for the display device according to the sampled signal. By sampling the stored pixel voltage of the storage element, whether the pixel voltages with different polarities are symmetry can be detected for avoiding flickers.

5 Claims, 6 Drawing Sheets

PIXEL CIRCUITRY OF DISPLAY DEVICE AND DISPLAY METHOD THEREOF

BACKGROUND OF THE INVENTION

1. Field of Invention

The present invention relates to a pixel circuitry of a display device, and more particularly, to a pixel circuitry that calibrates a common voltage of the display device.

2. Description of the Related Art

With great advance in the techniques of electro-optical and semiconductor devices, flat panel displays, such as liquid crystal displays (LCD), have enjoyed burgeoning development and flourished in recent year. Due to the numerous advantages of the LCD, such as low power consumption, free of radiation, and high space utilization, the LCD has become the main stream in the market. The LCD panel has no capacity of emitting light by itself so that a backlight module is disposed back to the LCD panel to provide a surface light source required by the LCD panel. The LCD panel displays the images by controlling an orientation direction of the liquid crystal to adjust a light transmittance and a light reflectance of the light source.

Generally, a pixel electrode and a common electrode are coupled to two terminals of the liquid crystal layer, respectively. A voltage of the pixel electrode varies with pixel signals, and the common electrode may be coupled to a common voltage. As known, the orientation direction of the liquid crystal is controlled by a voltage difference between two terminals of the liquid crystal layer and the electric field direction applied on the liquid crystal layer. In order to avoid liquid crystal polarization, polarity inversion is often performed on the LCD. Namely, voltages with different polarities, such as positive polarity and negative polarity, are alternatively used for driving liquid crystal at different time. Whether the voltage applied to the liquid crystal is the positive polarity or the negative polarity is determined according to the electric field direction applied on the liquid crystal. If the voltage of the pixel electrode is greater than the common voltage, the liquid crystal is driven with the positive polarity voltage. Otherwise, the liquid crystal is driven with the negative polarity voltage.

However, human eyes may perceive flickers on the display panel while performing polarity inversion since the common voltage provided to the common electrode would be affected by ambient temperature and then causes the positive polarity voltage and the negative polarity voltage are not symmetric. Generally, additional devices, such as a photo sensor, a flicker checker, and some related devices, are needed to adjust the common voltage before the LCD is shipped out from the factory. When the LCD is turned on, the photo sensor senses lights, which transmits through the liquid crystal and emits to the display panel, and thereby generates an electronic signal to the flicker checker. When the flicker checker shows that the electronic signal overly rises and falls, the flickers may occur on the display panel, so the common voltage should be manually calibrated. For example, a variable resistor or a digital to analog converter associated with the common voltage is adjusted.

The operations of sensing the lights and adjusting the common voltage should be carried out until the LCD system gets into thermal equilibrium for ensuring the calibration of the common voltage is correct. As a result, the calibration of the common voltage consumes time and hardware cost. In addition, inaccuracy calibration may occur during manual adjustment process.

SUMMARY OF THE INVENTION

The present invention provides a pixel circuitry of a display device and a display method thereof that calibrates the common voltage at high speed for avoiding occurrence of flickers while displaying.

A pixel circuitry of the display device is provided in the present invention. The pixel circuitry includes a scan switch, a storage element, and a sampling circuitry. A first terminal and a second terminal of the scan switch are respectively coupled to a data line and the storage element, wherein the scan switch is asserted according to a scan signal. The storage element stores a pixel voltage from the data line while the scan switch controlled by the scan signal is asserted. The sampling circuitry samples the stored pixel voltage of the storage element for generating a reference voltage for the display device.

According to an embodiment of the foregoing pixel circuitry, the sampling circuitry includes a first sample-and-hold unit, and a first filtering unit. The first sample-and-hold unit samples the stored pixel voltage of the storage element and thereby obtains a first sampled signal having a first polarity. The first filtering unit performs a low pass filtering processing on the first sampled signal for generating the reference voltage.

According to an embodiment of the foregoing pixel circuitry, the first sample-and-hold unit further samples the stored pixel voltage of the storage element and thereby obtains a second sampled signal having a second polarity. The first filtering unit generates the reference voltage according to the first sampled signal and the second sampled signal.

According to an embodiment of the foregoing pixel circuitry, the sampling circuitry further includes a second sample-and-hold unit, a first analog-to-digital converter (ADC), a second ADC, a processing unit, and a digital-to-analog converter (DAC). The second sample-and-hold unit samples the stored pixel voltage of the storage element, and thereby obtains a second sampled signal having a second polarity. The first ADC converts the first sampled signal into a first digital signal, and the second ADC converts the second sampled signal into a second digital signal. The processing unit analyzes the first sampled signal and the second sampled signal for obtaining a calibration signal. The DAC converts the calibration signal into the reference voltage.

A display method of a display device is provided herein. In the display method, a pixel voltage is stored into a storage element of a pixel circuitry, and the stored pixel voltage is sampled for obtaining a sampled signal. Next, the sampled signal is filtered and thereby a reference voltage is generated according to the filtered sampled signal for the display device.

According to an embodiment of the foregoing display method, the stored pixel voltage is sampled to obtain a first sampled signal having a first polarity. In addition, the stored pixel voltage is sampled to obtain a second sampled signal having a second polarity. The reference voltage is generated by filtering the first sampled signal and the second sampled signal.

The present invention provides the pixel circuitry and the display method thereof for calibrating the common voltage of the display device with the said reference voltage. Since a voltage across the storage element of the pixel circuitry can reflects a variation of the common voltage, the pixel circuitry samples the pixel voltages of the first polarity and the second polarity to know whether the pixel voltages with different polarities are symmetric, and thereby generates the reference voltage to calibrate the common voltage. Therefore, the pixel circuitry can avoid the flickers caused by the asymmetry between the pixel voltages with different polarities.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
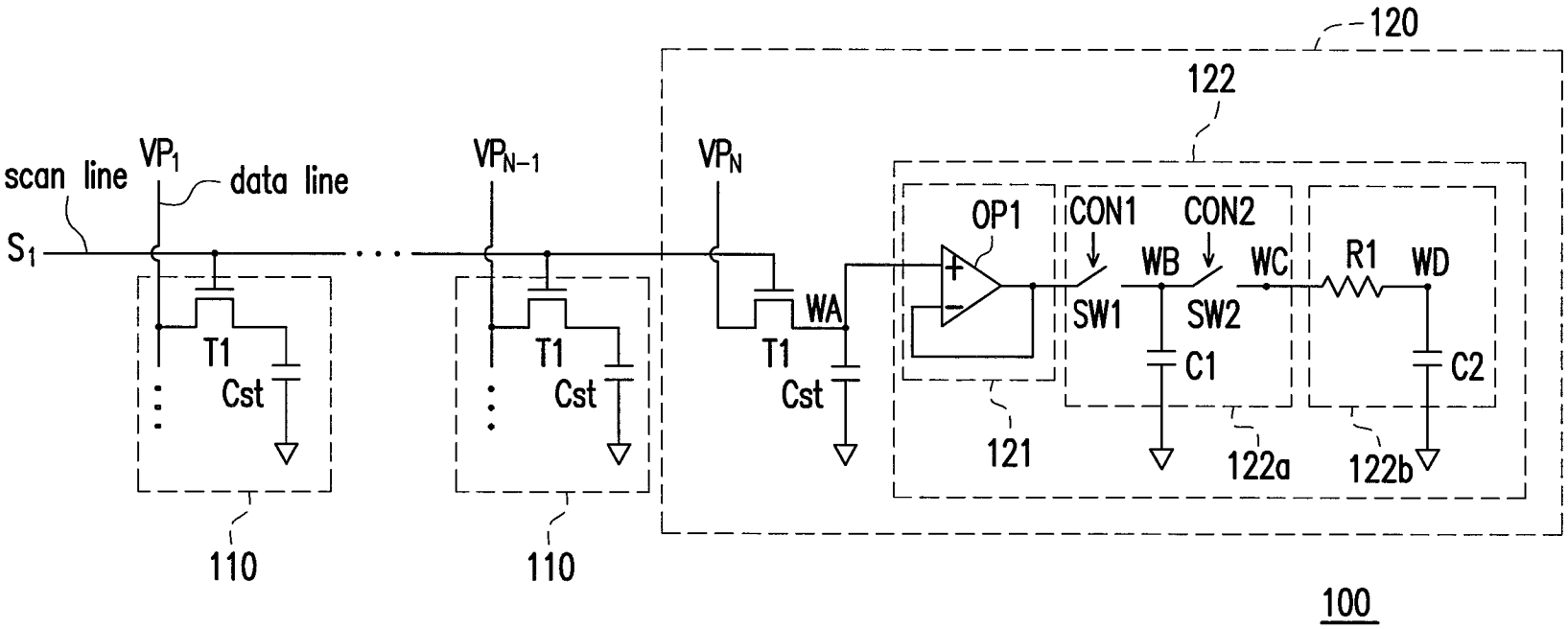
FIG. 1 is a circuit diagram of a display device according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

As known, a liquid crystal layer of a display device is coupled between a pixel electrode and a common electrode, wherein the pixel electrode receives a pixel voltage associated with a pixel signal and the common electrode couples to a common voltage VCOM. The orientation direction of the liquid crystal is controlled by a voltage difference between the said two electrodes and corresponding electric field applied on the liquid crystal layer. While a polarity inversion scheme is performed on the display device, flickers may occur due to asymmetric voltage differences corresponding to different polarities applied on the liquid crystal, wherein the asymmetric voltage difference are caused by the unstable common voltage VCOM. Thus, there is an embodiment of the present invention described below to teach a pixel circuitry that can assist in calibrating the common voltage.

FIG. 1 is a circuit diagram of a display device according to an embodiment of the present invention. Referring to FIG. 1, the display device 100 includes a plurality of pixel circuitries 110 disposed on a display panel in an array arrangement, wherein the display panel, for example, is a liquid crystal display (LCD) or a liquid crystal on silicon (LCOS) display panel. Generally, each pixel circuitry 110 includes a scan switch T1 and a storage element Cst. A first terminal and a second terminal of the scan switch T1 are respectively coupled to a data line and the storage element Cst. The scan switch T1 is asserted to be turned on according to a scan signal $S_1$ associated with a scan line. When the scan switch T1 is turned on, a pixel voltage, e.g. $VP_1$, is delivered from the data line to the storage element Cst via the scan switch T1. The storage element Cst stores the pixel voltage for driving liquid crystal and controlling orientation direction thereof.

In the embodiment of the present invention, there is at least one pixel circuitry 120 that includes the scan switch T1, the storage element Cst, and a sampling circuitry 122 in the display device 100. Similarly, in the pixel circuitry 120, when the scan switch T1 is turned on, a pixel voltage $VP_N$ is delivered to the storage element Cst and stored therein. The sampling circuitry 122 samples the stored pixel voltage of the storage element Cst and thereby generating a reference voltage for calibrating the common voltage VCOM of the display device 100 according to the sampled signal. When the polarity inversion scheme is performed, the sampling circuitry 122 may respectively samples the stored pixel voltages with different polarities. Accordingly, the sampled signals can be extracted to analyze whether the pixel voltages with different polarities are symmetric, and further to calibrate the common voltage VCOM for reducing flickers caused by asymmetry voltage differences corresponding to different polarities.

Referring to FIG. 1, in the embodiment of the present invention, the sampling circuitry 122 includes a voltage follower 121, a sample-and-hold unit 122*a*, and a filtering unit 122*b*. The voltage follower 121 is implemented by an operational amplifier OP1 which has a non-inverted terminal coupled to the storage element Cst, and an inverted terminal coupled to an output terminal thereof, wherein an output voltage of the voltage follower 121 follows or tracks an input voltage according to the stored voltage in the storage element Cst. The sample-and-hold unit 122*a* includes switches SW1-SW2 and a capacitor C1. The switch SW1 coupled between the output terminal of the voltage follower 121 and the capacitor C1 is turned on according to a switching signal CON1 for storing the output voltage of the voltage follower 121 in the capacitor C1. The switch SW2 coupled between the switch SW1 and the filtering unit 122*b* is turned on according to a switching signal CON2 for extracting the stored voltage in the capacitor C1. By alternatively turning on the switches SW1 and SW2, the sample-and-hold unit 122*a* samples the output voltages of the voltage follower 121 for obtaining at least a first sampled signal and a second sampled signal corresponding to the pixel voltages with different polarities, such as positive polarity and negative polarity. The filtering unit 122*b* includes a resistor R1 and a capacitor C2 in series connection. The filtering unit 122*b* performs a low pass filtering process on the sampled signals for obtaining the reference voltage at a connection node of the resistor R1 and the capacitor C2.

Figure 2A:
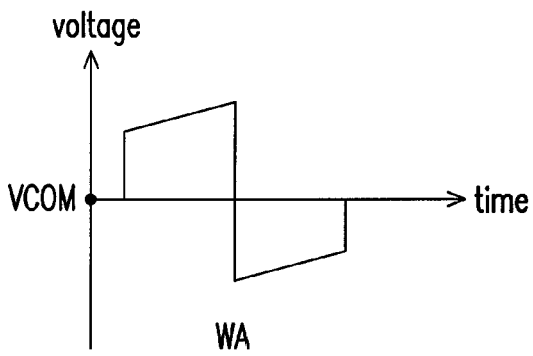
FIG. 2A, FIG. 2B, FIG. 2C and FIG. 2D are waveforms of the signals at nodes WA, WB, WC, and WD in the pixel circuitry according to the embodiment in FIG. 1.
Figure 2B:
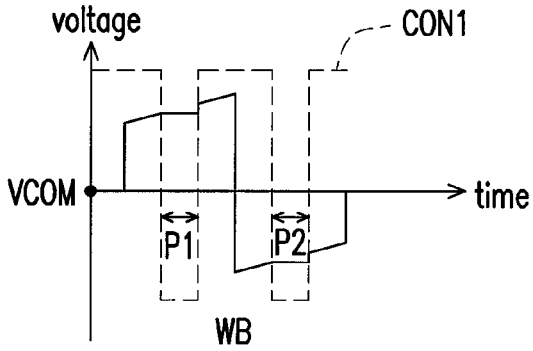
Figure 2C:
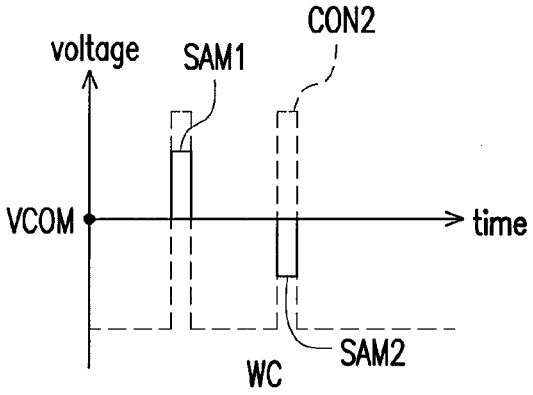

FIG. 2A, FIG. 2B, FIG. 2C and FIG. 2D are waveforms of the signals at nodes WA, WB, WC, and WD in the pixel circuitry 120 according to the embodiment in FIG. 1. Referring to FIG. 2A, the pixel voltage $VP_N$ with the positive polarity and the pixel voltage $VP_N$ with the negative polarity are delivered to the node WA of the storage element Cst at different time via the conducted scan switch T1, wherein the pixel voltage with positive polarity is higher than the common voltage VCOM, and the pixel voltage with negative polarity is lower than the common voltage VCOM. The waveform of the pixel voltages $VP_N$ with different polarities as shown in FIG. 2A is asymmetric in reference to the common voltage VCOM. Referring to FIG. 2B and FIG. 2C, the stored pixel voltage with the positive polarity in the storage element Cst is delivered to the sample-and-hold unit 122*a* via the voltage follower 121. When the switch SW1 is turned on and the switch SW2 is turned off, the stored pixel voltage is delivered to node WB for charging the capacitor C1. After a short period PI, the switch SW1 is turned off and the voltage at the node WB is maintained by the capacitor C1. In the meanwhile, the switch SW2 is turned on and the stored voltage in the capacitor C1 is delivered to the node WC for obtaining the first sampled signal SAM1. Consequently, the first sampled signal SAM1 corresponding to the pixel voltage with the positive polarity is obtained.

Figure 2D:
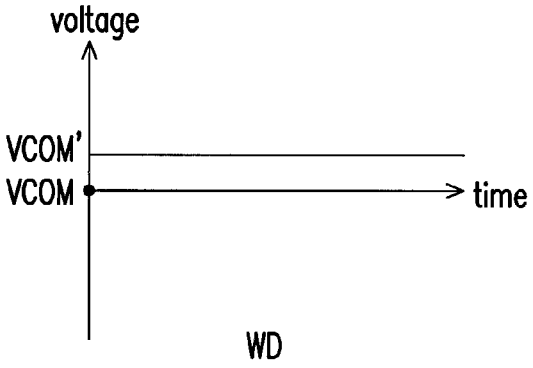

Similarly, referring to FIG. 2B and FIG. 2C, the stored pixel voltage with the negative polarity in the storage element Cst is sampled by the sample-and-hold unit 122*a* and obtains the second sampled signal SAM2 corresponding to the pixel voltage with the negative polarity. Referring to FIG. 2D, the filtering unit 122*b* performs the low pass filtering process on the first sampled signal SAM1 and the second sampled signal SAM2 for generating the reference voltage VCOM'. In the embodiment of the present invention, the reference voltage VCOM' is substantially equal to an average voltage of the first sampled signal SAM1 and the second sampled signal SAM2. As illustrate before, the pixel voltages with different polarities are asymmetric in reference to the common voltage VCOM. For the reason, the average voltage of the sampled signals is provided to calibrate the common voltage VCOM. Accordingly, the sampling circuitry 122 can calibrate the common voltage VCOM by the generated reference voltage VCOM' for making the pixel voltages with different polarities symmetric and then reducing flickers perceived by human eyes.

Figure 3:
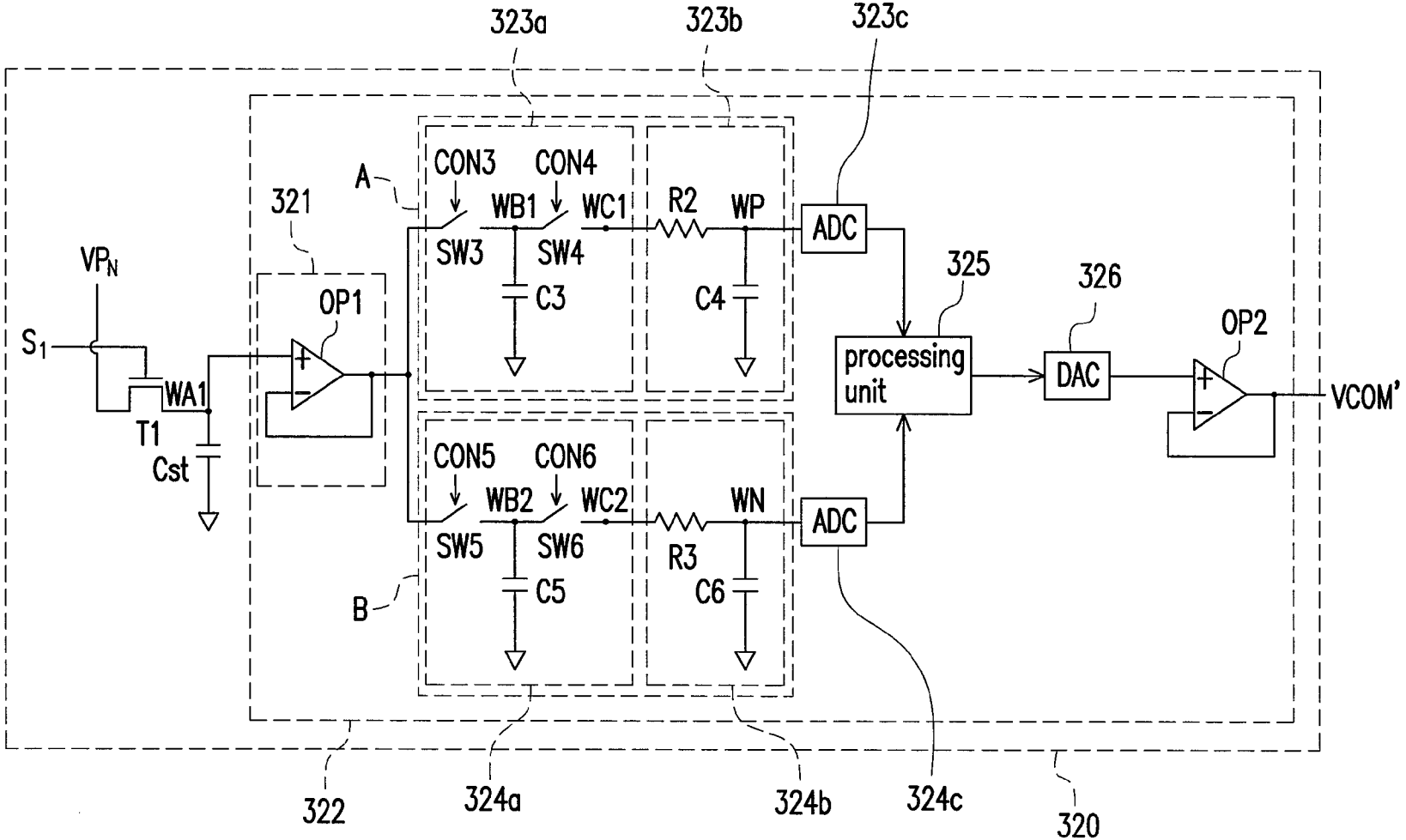
FIG. 3 is a circuit diagram of a pixel circuitry of a display device according to an embodiment of the present invention.

In order to make people ordinarily skilled in the art to practice the present invention easily, there is another embodiment accompanied with figures described in detail below. FIG. 3 is a circuit diagram of a pixel circuitry of a display device according to another embodiment of the present invention. Referring to FIG. 3, a pixel circuitry 320 includes a scan switch T1, a storage element Cst, and a sampling circuitry 322. The sampling circuitry 322 includes a voltage follower 321, sample-and-hold units 323*a*-324*a*, filtering units 323*b*-324*b*, analog-to-digital converters (ADC) 323*c*-324*c*, a processing unit 325, and a digital-to-analog converter (DAC) 326. The voltage follower 321, the sample-and-hold units 323*a*-324*a*, and the filtering units 323*b*-324*b* have the same configuration as those in FIG. 1. The difference between the embodiments in FIG. 1 and FIG. 3 is that the sample-and-hold units 323*a*-324*a* and the filtering units 323*b*-324*b* are arranged into two branches A-B. The branch A is configured to obtain a positive reference voltage corresponding to the pixel voltage with the positive polarity and then the ADC 323*c* converts the positive reference voltage into a first digital signal. Similarly, the branch B is configured to obtain a negative reference voltage corresponding to the pixel voltage with the negative polarity and then the ADC 324*c* converts the negative reference voltage into a second digital signal. The processing unit 325, e.g. microprocessor control unit (MCU), respectively receives and analyzes the first digital signal and the second digital signal for obtaining a calibration signal. The obtained calibration signal is converted into a reference voltage VCOM' by the DAC 326. As mention before, the reference voltage VCOM' is generated for calibrating the common voltage VCOM.

Figure 4A:
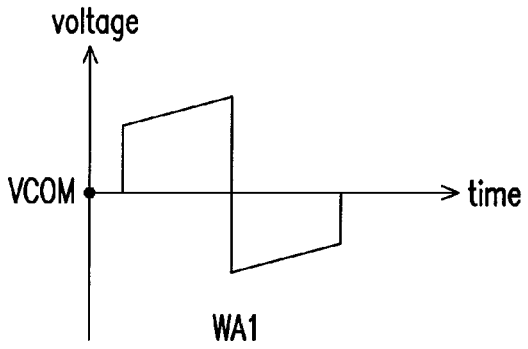
FIG. 4A, FIG. 4B, FIG. 4C and FIG. 4D are waveforms of the signals at nodes WA1, WB1, WC1, and WP in the pixel circuitry according to the embodiment in FIG. 3.
Figure 4B:
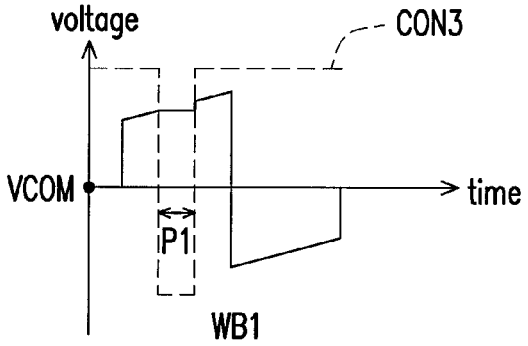
Figure 4C:
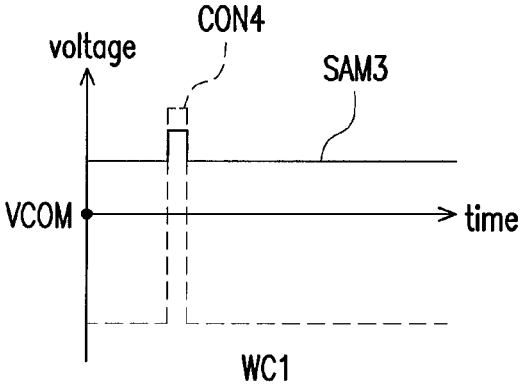
Figure 4D:
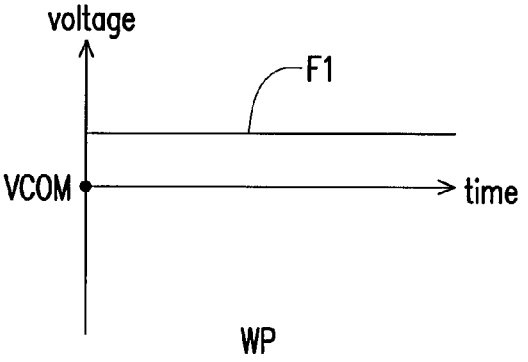

FIG. 4A, FIG. 4B, FIG. 4C and FIG. 4D are waveforms of the signals at nodes WA1, WB1, WC1, and WP in the pixel circuitry 320 according to the embodiment in FIG. 3. FIG. 4A represents the pixel voltage $VP_N$ with positive polarity and negative polarity delivered to the node WA of the storage element Cst at different time. Referring to FIG. 4B and FIG. 4C, the stored pixel voltage with positive polarity in the storage element Cst is sampled by the sample-and-hold unit 323*a*. In the meanwhile, a sampled signal SAM3 corresponding to the pixel voltage is obtained. Then referring to FIG. 4D, the filtering unit 323*b* performs the low pass filtering process on the sampled signal SAM3 and generates a positive reference voltage F1 corresponding to the pixel voltage with the positive polarity at the node WP.

Figure 5A:
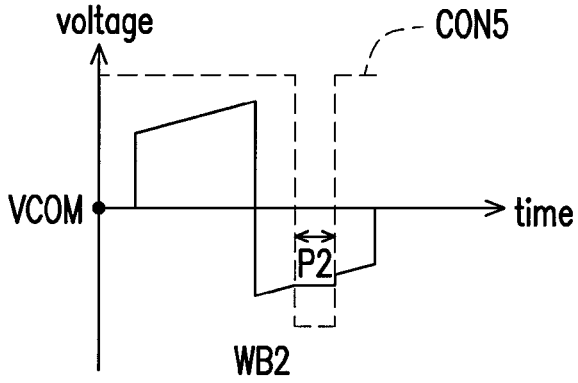
FIG. 5A, FIG. 5B and FIG. 5C are waveforms of the signals at nodes WB2, WC2, and WN in the pixel circuitry according to the embodiment in FIG. 3.
Figure 5B:
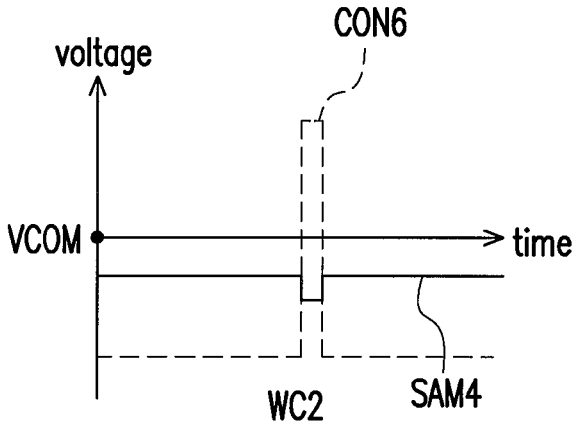
Figure 5C:
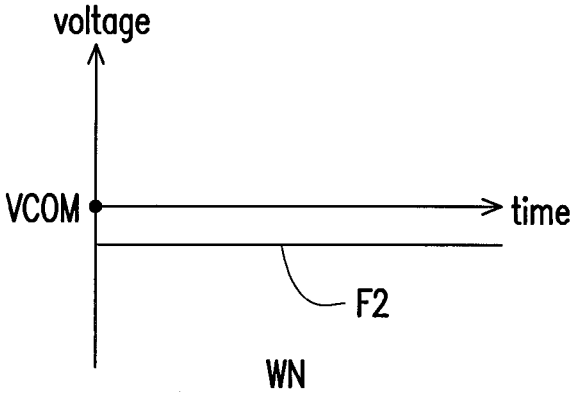

FIG. 5A, FIG. 5B, and FIG. 5C are waveforms of the signals at nodes WB2, WC2, and WN in the pixel circuitry 320 according to the embodiment in FIG. 3. Referring to FIG. 5A, FIG. 5B, and FIG. 5C, the stored voltage with negative polarity in the storage element Cst is sampled by the sample-and-hold unit 324*a* and a sampled signal SAM4 corresponding to the pixel voltage is obtained. Then, the filtering unit 324*b* performs the low pass filtering process on the sampled signal SAM4 and generates a negative reference voltage F2 corresponding to the pixel voltage with the negative polarity.

The analog-to-digital converters 323*c*-324*c* respectively converts the reference voltages F1-F2 into the first digital signal and the second digital signal. The processing unit 325 receives and analyzes the first digital signal and the second digital signal in statistics to obtain the calibration signal. Then, the DAC 326 converts the calibration signal into the reference voltage VCOM' to calibrate the common voltage.

It is noted that people ordinarily skilled in the art can uses more than one pixel circuitry 120/320 in series connection to practice the calibration of the common voltage according to the teaching of the said embodiments, and the pixel voltage can be a voltage converted from a gray scale or a particular test voltage. In addition, the voltage follower 121/321 recited in the said embodiments is optional and the number of the voltage follower is designed as requirement, so the present invention is not limited thereto.

Figure 6:
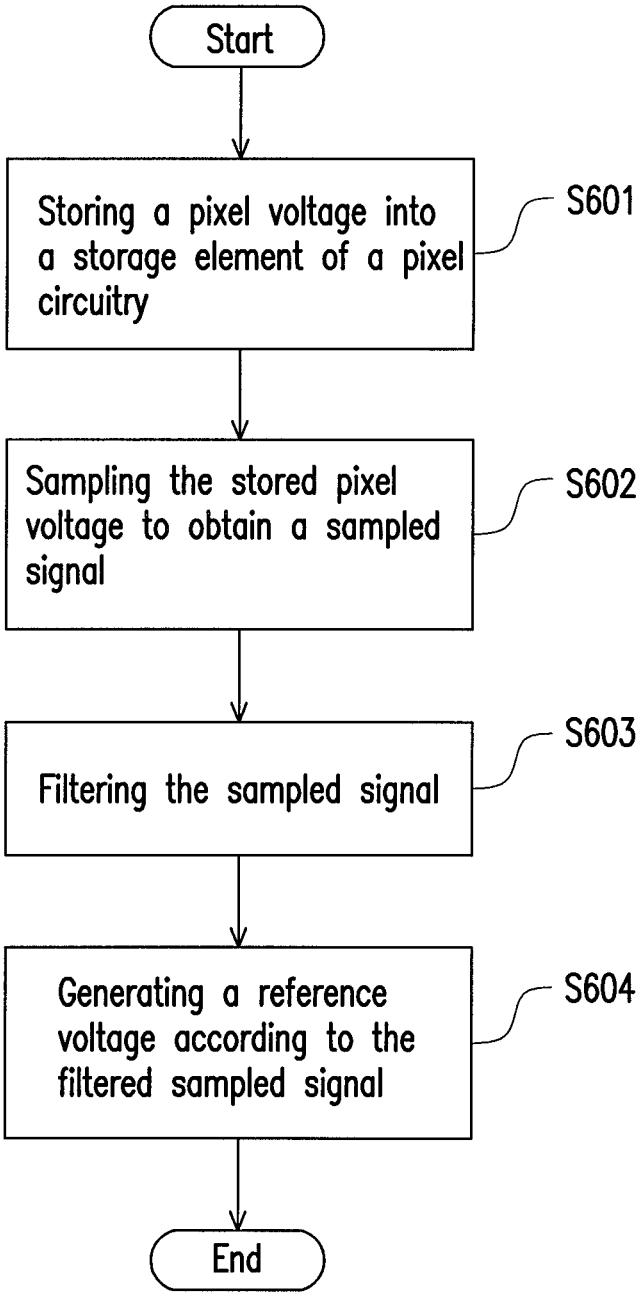
FIG. 6 is a flow chart of a display method according to an embodiment of the present invention.

According to the embodiments described above, the steps of the following method could be generalized. FIG. 6 is a flow chart of a display method according to an embodiment of the present invention. Referring to FIG. 6, a pixel voltage, such as a voltage converted from a gray scale or a test voltage, is stored into a storage element of a pixel circuitry 120 in step S601. The stored pixel voltage of the storage element Cst is sampled to obtain a sampled signal in step S602. In steps S603 and S604, the sampled signal is filtered to generate a reference voltage according to the filtered sampled signal for the display device according to the filtered sampled signal.

In summary, the said embodiments provide the pixel circuitry that can samples the pixel voltages with different polarities and thereby generates the reference voltage to calibrate the common voltage, since the common voltage of the display device changes associated with the ambient temperature and results in asymmetry between the pixel voltages with different polarities. Therefore, the said embodiment can auto-calibrate the common voltage under different ambient temperature for reducing time of mass production, and avoiding flickers.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A pixel circuitry of a display device, comprising:

a scan switch, coupled to a data line and configured to be asserted according to a scan signal;

a storage element, coupled to the scan switch and configured to store a pixel voltage from the data line; and a sampling circuitry, coupled to the storage element and configured to sample the stored pixel voltage of the storage element for generating a reference voltage for calibrating a common voltage provided to a plurality of pixels in the display device, wherein the sampling circuitry comprises:

a first sample-and-hold unit, sampling the stored pixel voltage of the storage element and sequentially obtaining a first sampled signal having a first polarity and a second sampled signal having a second polarity;

a first filtering unit, performing a low pass filtering process on the first sampled signal and the second sampled signal, and the reference voltage is obtained in the first filtering unit; and a voltage follower, coupled to the storage element and the first sample-and-hold unit for buffering the stored pixel voltage of the storage element, wherein the voltage follower comprises an operational amplifier having a first input terminal coupled to the storage element, and both of a second input terminal and an output terminal coupled to the first sample-and-hold unit, wherein the reference voltage is equal to an average voltage of the first sampled signal and the second sampled signal.

2. The pixel circuitry as claimed in claim 1, wherein the first sample-and-hold unit comprises:

a first switch, having a control terminal receiving a first switching signal, a first terminal coupled to the storage element, and a second terminal;

a second switch, having a control terminal receiving a second switching signal, a first terminal coupled to the second terminal of the first switch, and a second terminal coupled to the first filtering unit; and a first capacitor, coupled to the second terminal of the first switch and a first terminal of the second switch.

3. The pixel circuitry as claimed in claim 1, wherein the first filtering unit comprises:

a first resistor, coupled to the first sample-and-hold unit; and a first capacitor, coupled to the first resistor for outputting the reference voltage.

4. A display method of a display device, comprising:

storing a pixel voltage into a storage element of a pixel circuitry;

buffering the stored pixel voltage by a voltage follower coupled between the storage element and a first sample-and-hold unit;

sampling the stored pixel voltage and obtaining a first sampled signal having a first polarity and a second sampled signal having a second polarity by the first sample-and-hold unit;

filtering the first sampled signal and the second sampled signal by a first filtering unit;

generating a reference voltage in the first filtering unit according to the first sampled signal and the second sampled signal, wherein the reference voltage is equal to an average voltage of the first sampled signal and the second sampled signal; and calibrating a common voltage provided to a plurality of pixels according to the reference voltage for the display device.

5. A pixel circuitry of a display device, comprising:

a scan switch, coupled to a data line and configured to be asserted according to a scan signal;

a storage element, coupled to the scan switch and configured to store a pixel voltage from the data line; and a sampling circuitry, coupled to the storage element and configured to sample the stored pixel voltage of the storage element for generating a reference voltage for calibrating a common voltage provided to a plurality of pixels in the display device, wherein the sampling circuitry comprises:

a first sample-and-hold unit, sampling the stored pixel voltage of the storage element and obtaining a first sampled signal having a first polarity;

a second sample-and-hold unit, sampling the stored pixel voltage of the storage element and obtaining a second sampled signal having a second polarity;

a first filtering unit, performing a low pass filtering process on the first sampled signal to generate a first reference voltage with the first polarity;

a second filtering unit, performing the low pass filtering process on the second sampled signal to generate a second reference voltage with the second polarity;

a first analog-to-digital converter, converting the first reference voltage into a first digital signal;

a second analog-to-digital converter, converting the second reference voltage into a second digital signal;

a processing unit, analyzing the first digital signal and the second digital signal for obtaining a calibration signal;

a digital-to-analog converter, converting the calibration signal into the reference voltage; and a voltage follower, coupled to the storage element, the first sample-and-hold unit and the second sample-and-hold unit for buffering the stored pixel voltage of the storage element, wherein the voltage follower comprises an operational amplifier having a first input terminal coupled to the storage element, and both of a second input terminal and an output terminal coupled to the first sample-and-hold unit and the second sample-and-hold unit.

* * * * *